United States Patent [19]

Feldman et al.

[11] Patent Number: 4,979,706

[45] Date of Patent: Dec. 25, 1990

[54] BAG RESTRAINING SYSTEM AND METHOD OF USE

[76] Inventors: Francis J. Feldman, 10081 Manderson St., Omaha, Nebr. 68134; Richard L. Feldman, 10350 N. 142nd, Lincoln, Nebr. 68462

[21] Appl. No.: 421,365

[22] Filed: Oct. 13, 1989

[51] Int. Cl.[5] ..... B65B 67/04

[52] U.S. Cl. ..... 248/101; 248/98

[58] Field of Search ..... 248/97, 98, 99, 100, 248/101, 316.1, 316.2, 316.5

[56] References Cited

U.S. PATENT DOCUMENTS

| | | | |
|---|---|---|---|
| 440,073 | 11/1890 | Tryon | 248/101 |
| 1,019,366 | 3/1912 | Sargent | 248/101 |
| 1,713,095 | 5/1929 | Scheffler | 248/101 |
| 1,762,475 | 6/1930 | Hirsch | 248/98 |
| 2,788,947 | 4/1957 | Kleiser | 248/97 |
| 3,041,026 | 6/1962 | Wilson | 248/98 |
| 3,297,287 | 1/1967 | Larson | 248/101 |
| 3,298,647 | 1/1967 | Shepard | 248/101 |
| 3,870,261 | 3/1975 | McSwain | 248/98 X |
| 4,124,185 | 11/1978 | Preisinger | 248/98 |
| 4,179,132 | 12/1979 | Rich | 248/98 X |
| 4,448,434 | 5/1984 | Anderson | 248/98 X |
| 4,669,609 | 6/1987 | McEniry | 248/101 |
| 4,707,889 | 11/1987 | Sato | 248/101 X |

FOREIGN PATENT DOCUMENTS

| | | | |
|---|---|---|---|
| 0319434 | 3/1919 | Fed. Rep. of Germany | 248/101 |
| 0498721 | 5/1930 | Fed. Rep. of Germany | 248/101 |
| 0035496 | 9/1913 | Sweden | 248/98 |

*Primary Examiner*—Carl D. Friedman
*Assistant Examiner*—Daniel Hulseberg
*Attorney, Agent, or Firm*—James D. Welch

[57] ABSTRACT

A bag restraining system, and method of its use is diclosed. The bag restraining system, in its preferred embodiment, provides a device that can be easily attached to existing two wheel transport units while providing a vast range of vertical and horizontal adjustment necessary to effectively restrain and accommodate bages of various lengths and/or diamters. The system provides for the quick and easy removal of the protruding elements, on which bags are restrained, from the two wheel transport unit to allow immediate use of the two wheel transport unit in a material transport capacity when desired. The system incorporates automatic gripping, force controlling and distributing compressible material elements which, either alone or in conjunction with forces developed by rotating members, control and distribute the restraining forces exerted on a restrained bag. The system also provides for quick and easy bag release. Said attributes help to prevent the development of high stresses in restrained bags which result from application of large forces at points thereon, and thereby minimize the possibility that bags restrained in the system will be torn. The system is also essentially self contained thereby minimizing the chance that parts thereof will be lost.

9 Claims, 3 Drawing Sheets

BAG RESTRAINING SYSTEM AND METHOD OF USE

TECHNICAL AREA

This invention relates to bag restraining systems and more particularly to a system and method of use for restraining bags in an open position which can be mounted on two wheel transport units.

BACKGROUND

Numerous Patents have issued for apparatus which is useful in restraining bags open and in place so that they can be filled easily. Of interest, for example, is a recent Patent to McEniry, No. 4,669,690. Taught in McEniry is an apparatus which serves to suspend bags of varying sizes from a hoop. The bags, which are at their open end pulled up and over the inner side of the hoop and then down over the outer side of the hoop, are secured to the hoop by way of independent clips. The hoop attaches to a plate which in turn is attached to a stable support such as a cabinet door. The McEniry invention, however does not allow quick removal of bags per se by simple one step user action, nor does the McEniry invention provide for attachment to two wheel transport units. A Patent to Schieffler, No. 1,713,095, on the other hand, teaches a polygon shaped bag holding apparatus which attaches, firmly, to a two wheel transport unit. The Schieffler invention also provides more convenient means for securing a bag to a holding member in the form of eccentrically mounted clamps. In use a bag is pulled up and over the inner side of a holding member and then down between the eccentrically mounted clamp and the outer side of the holding member. As the held bag is filled the weight of the material entered causes a tendency for the bag to pull free of the holding member, but the eccentrically mounted clamps convert that tendency to a tighter grip between the eccentrically mounted clamps and the holding member, between which, as described, is the bag. The Schieffler invention also provides for adjustment of the vertical position of the holding member on the two wheel transport unit. While the benefit of the bag restraining means in Schieffler is noted, it is also noted that the eccentrically mounted clamps operate independent of one another, much as do the independent clips of the McEniry invention. It is not possible to quickly, in a one step motion, release held bags from all of the clamps. One must operate each clamp individually, thereby causing uneven bag release. The result is that bags tend to tear when released because restraining force is transferred to fewer points prior to total release. A Patent to Sargent, No. 1,019,366 teaches an invention which strives to overcomes this drawback, and which also makes use of eccentrically mounted clamps to secure bags. The eccentrically mounted clamps, (called moveable jaws), however, are mounted so that rather than pulling the open end of a bag up and over the inner side of a holding member prior to inserting it between the outer side of the holding member and an eccentrically mounted clamp, the bag is simply pulled up between the inner side of a fixed jaw and a moveable jaw. The fixed jaw is the equivalent to the holding member in Schieffler and the moveable jaw is the equivalent of the eccentrically mounted clamp therein. The tendency of a bag to pull straight down and away from the apparatus when weight is placed therein is converted to tighter gripping by the action of the mechanism in what might be termed an inverted form of the action of the apparatus described in the Schieffler invention. The Sargent invention includes means for operating the two clamps on each side of the bag holding apparatus simultaneously by an easy user motion. This facilitates the release of a filled bag without the bag tearing. However, the Sargent invention does not provide the force distributing benefit found in the McEniry and Schieffler inventions which results from the pulling the bag up and over the inner side of a bag holding member prior to clipping or clamping the bag at specific points to restrain and hold the bag.

While the Sargent invention provides benefits not found in Schieffler or McEniry, and vice versa, all the Patents so far discussed teach the holding of bags by forces presented at points on bags rather than applying force along a locus on a bag. While the McEniry and Schieffler inventions are less affected than the Sargent invention in this regard, all three inventions potentially cause mounted bags, such as plastic garbage bags, to tear at the point of restraint when any significant weight is placed therein. The tears occur where the force is concentrated by the use of clips, eccentrically mounted clamps or moveable jaws.

A Patent to Kleiser, No. 2,788,947 teaches an invention which provides for mounting a bag between an inner and outer quadralateral frame which frame distributes the bag holding restraining force along a locus on the bag near its open top edge. The invention in Kleiser also provides means for easily releasing a held bag. Kleiser, however, as is the case with the Sargent invention, does not efficiently provide for use with bags of greatly differing sizes by allowing the bag holding frame to vary with bag size.

As alluded to earlier, the Schieffler invention provides for attachment to a two wheel transport unit in a firm way. That is, it is not easy to remove the Schieffler apparatus from the two wheel transport unit when its use for other than a bag holder is desired. The McEniry invention provides for easy removal of the bag restraining apparatus taught therein, but no provision for use on a two wheel transport device was taught. A Patent to Preisinger, No. 4,124,185, teaches a bag restraining invention for use on a two wheel transport unit, and which can be easily attached to and removed from the two wheel transport unit when use of the two wheel transport unit for other purposes is desired. The Preisinger invention, however, teaches a very inconvenient means for securing a bag to a restraining mechanism. The means is a cord, which cord is simply tied around the top edge of a bag which has been pulled up and over the inner side of a holding bracket and then down over the outer side of said holding bracket.

One approach to providing for easy two wheel transport unit coversion between use as a bag retainer and as a material transport unit is taught in a Patent to Wilson, No. 3,041,026. In that Patent a two wheel transport unit is taught which provides arms which protrude from the two wheel transport unit's framework and which are used as a bag restraining means. The protruding arms are pivotally attached to the two wheel transport unit and can be rotated so that they no longer protrude when it is desired to use the two wheel transport unit as a material transport unit. The Wilson invention, however, does not provide for easy removal of the arms, the presence of which arms is potentially akward when the two wheel transport unit is used for material transport.

As well, the attachment means for bags in Wilson comprise prongs on the arms upon which a bag is impaled. Such a means is not compatible for use with common plastic bags, and other easily torn bags.

From the above summary of relevant prior Patents it can be concluded that many inventors have received Patents for bag restraining apparatus. The many Patents individually teach many elements which provide users of the inventions a wide variety of benefits. However, no Patent of which the Inventor herein is aware provides at once for:

(1) Easy installation of the apparatus to any stable support, which support can be a two wheel transport unit.

(2) Easy adjustment of the vertical location where the apparatus mounts on a two wheel transport unit.

(3) Quick attachment to, and removal of elements which protrude from, a two wheel transport unit so said unit can be quickly converted from a configuration for use as a bag restrainer to a configuration for use as a material transport unit.

(4) Easy adjustment for use with varying sized bags.

(5) Easy mounting of bags in a system which utilizes rotating bag restraining means, and which can include bag gripping force controlling and distributing elements, in a manner which prevents development of high point applied stress causing forces which can cause bag tearing while gripped bags are held and when they are released.

(6) Quick mounting and one step release of bags which eliminates the need for cords or other independent attachment devices, eg. clips etc.

(7) Minimal maintenance requirements.

DISCLOSURE OF THE INVENTION

The present invention, at once, provides a bag restraining system which is easy to install at adjustable vertical height positions on two wheel transport units; which can be easily adjusted for use with bags of various diameters; which allows easy removal of protruding bag holding elements which project from a two wheel transport unit to which said present invention is attached and which otherwise preclude its use as a material transport unit; which is designed to restrain bags in a tear preventing controlled bag gripping force distributing manner; which allows for quick, easy one step bag release; which is essentially self contained thereby minimizing the chance of misplacing parts which are required to restrain bags in the system and which requires minimal maintenance.

The present invention is intended for use primarily, but not exclusively, with material transport units of the type commonly called "dollies". Such material transport systems have two wheels and a material support stand on the bottom thereof, and two tubular uprights which project vertically when the two wheel transport unit is oriented upright. The tubular uprights normally serve as supports for transported materials, and as handles which users can grip.

The present invention has as a first element a base mounting rail, which when viewed in frontal elevation with its longitudinal dimension oriented horizontally, has complimentary elongated slots therein on the right and left sides of its longitudinal center line, which longitudinal center line is vertically perpendicular to the longitudinal dimension of the base mounting rail at the longitudinal mid point thereof, and which elongated slots are in line with, or parallel to, the vertical center line, which vertical center line transverses the longitudinal length of the base mounting rail at half the vertical height thereof. Said elongated slots are positioned in the base mounting rail such that when the base mounting rail is positioned against a vertically upright two wheel transport unit, so that its longitudinal dimension is oriented horizontally and its width dimension vertically, the elongated slots are positioned to allow access to, simultaneously, the two tubular uprights of the upright two wheel transport unit. The elongated slots are sufficiently long to allow use of the invention with all standard two wheel transport units. That is, the base mounting rail is sufficiently long so that when oriented as described above, with respect to a two wheel transport unit, it simultaneously projects laterally beyond both tubular uprights of the two wheel transport unit, and the elongated slots in the base mounting rail are sufficiently long to allow simultaneous access to both sides of each of the two tubular uprights on the two wheel transport unit.

The base mounting rail is secured to the tubular uprights of the two wheel transport unit by way of clamping blocks, one at each tubular upright location, which clamping blocks are positioned such that bolts extending through the elongated slots in the base mounting rail can extend through holes in the clamping blocks, which holes are positioned to be simultaneously on both sides of each tubular upright of the two wheel transport unit. Said bolts are then secured, at the back side of the clamping blocks, by wing nuts or equivalent elements, thereby clamping the tubular uprights of the two wheel transport unit between the clamping blocks at the back, and the back of the base mounting rail at their forward aspect, as the two wheel transport unit is viewed from the front in elevation.

The base mounting rail also provides a series of connection means, such as key slots, along the length thereof. The connection means are oriented such that complimentary connection means, such as keys, which are attached to the back breadth dimensional area aspect of the side arms, can be easily inserted therein and removed therefrom, thereby allowing said side arms to be easily mountable to and removeable from the base mounting rail at positions along the base mounting rail which cause various distances to exist between the mounted side arms. Note that the side arms project and protrude perpendicularly forward from the plane formed by the tubular uprights of the material transport system to which they, via the base mounting rail, are attached.

In the preferred embodiment, on the outer vertical surfaces of the side arms, are mounted, by way of pivot brackets, restraining levers. Said restraining levers allow easy restraint of bags between the outer vertical surfaces of said side arms, and the lengths of their respective restraining levers which contact the outer vertical surfaces of the side arms when the system is in a closed restraining space position, (ie. said restraining levers are not rotated so as to create a space between the outer vertical surfaces of the side arms and the restraining levers). As mentioned, the restraining levers are attached to the outer vertical surfaces of the side arms by way of pivot brackets and pivot pins, around which pivot pins the restraining levers can rotate through a partial arc. The arc of allowed rotation is limited by the outer vertical restraining arm surfaces and/or by the top of the pivot brackets in one direction, and by the inside surface of the pivot bracket in the opposite direction. This is the result of the size and shape and the way the restraining levers are mounted to the pivot brackets. The restraining levers are shaped similar to a boomerang, as viewed in cross section in frontal elevation when attached to a two wheel transport unit via a base mounting rail, side arms and pivot pivot brackets. The pivot pin connections to the pivot brackets are at the bend point of the boomerang shape, on the concave side thereof. As viewed from the front in elevation, one extent of a restraining lever projects from the pivot pin connection point to the pivot bracket downward and toward the associated outer vertical side arm surface, and the outer extent thereof projects horizontally away from said outer vertical surface of the associated side arm. It is the downward projecting extent which contacts the outer vertical surface of the associated side arm and the horizontally projecting extent which, at its lower aspect, contacts the top of the pivot bracket to which the restraining lever is pivotally attached.

Note also that torsion force producing springs can be mounted at the locations of the pivot pins, which torsion force producing springs attach to the pivot brackets and to the restraining levers in a manner which provides a force to be applied to the restraining levers which causes the restraining levers to normally assume a position with the downward projecting extent of each in contact with the outer vertical surface of the associated side arm when the system is in the closed restraining space position. However, the restraining levers can be designed with proper weighting to achieve the same effect without the requirement of springs. Continuing, it will be appreciated that if a two wheel transport unit is fitted with the present invention base mounting rail and side arms as described, and a bag is then positioned such that its top open edge is pulled up past the inner vertical surfaces of the side arms, then over the tops of the side arms and down over the outer vertical surfaces of the side arms, between said outer vertical surfaces of the side arms and the length of the restraining levers which contact said outer vertical surfaces of the side arms when the system is in the closed restraining space position, then a configuration presents in which the system of the present invention grasps and restrains the so positioned bag.

It is most important to realize that the bag alluded to can be caused to assume the position described by very simple user action. One can, without specifically rotating the restraining levers, simply grasp the top open edge of a bag with a length thereof slightly longer than the length of a restraining lever between his or her hands, and slide same between one outer vertical surface of a side arm and the associated restraining lever, and then repeat the process at the other side arm location. It will be understood said action will cause the restraining lever on the left of the two wheel transport unit to rotate slightly clockwise and the restraining lever on the right of same will rotate slightly counterclockwise to provide a space between the outer vertical surface of each side arm and the respective associated restraining lever for the top open edge of the bag to occupy. Again, do note that no specific user applied force must be provided to the restraining levers per se. Said restraining levers are caused to rotate slightly by the action of the top open edge of the bag being slid into the system, which open top edge of said bag contacts the restraining levers.

Also, to aid with understanding the foregoing, please note that the right and left side arms are mirror images of one another, and that rotation actions attributed to one of said restraining levers on one side arm will always require an opposite rotation of the restraining lever on the opposite side arm for the present invention to be utilized.

When a bag is restrained by the system of the present invention as described, any attempt to pull the bag free, such as is created by placing material with weight associated therewith therein, will serve, via system action, to better restrain the bag. Only user action comprising rotating the restraining levers to create a large space between the outer vertical surfaces of the side arms and their associated restraining levers can cause release of a restrained bag.

It will be appreciated that the present invention can be easily mounted, and adjusted, as regards vertical positioning of the invention on a two wheel transport unit, and that the side arms can be very easily mounted at various distances apart from one another by utilization of varyious key slots, or functionally equivalent connection means, on the base mounting rail. The vertical positioning is easily adjusted by loosening the wing nuts, or equivalent securing elements, to loosen the clamping of the tubular uprights of the two wheel transport unit between the clamping blocks and the back of the base mounting rail, (as the invention is viewed in frontal elevation on a vertically oriented two wheel transport unit), and then moving said invention clamping blocks and base mounting rail to a new vertical position, up or down, on the two wheel transport unit and retightening the wing nuts, or equivalent securing elements to again clamp the tubular uprights of the two wheel transport unit. The distance between the two side arms can be easily adjusted by simply removing the connection means on the back breadth dimensional area aspect of the side arms from the connection means on the base mounting rail, and placing said side arm connection means into alternate connection means on the base mounting rail. Thus, easy adjustments are possible to accommodate use of the invention with bags of various lengths and/or diameters.

Next, and most importantly, in the preferred embodiment of the present invention, the lengths of the restraining levers which contact the outer vertical side arm surfaces when the system is in a closed restraining space position are fitted with gripping force controlling and distributing compressible material elements. The purposes of said gripping force controlling and distributing compressible material elements are to enhance a continuous force distributing contact between the gripping force controlling and distributing compressible material elements and the outer vertical surfaces of the side arms, and to provide a mechanism by which the gripping force applied to a restrained bag is controlled by means of said gripping force controlling and distributing compressible material elements, independently of restraining lever rotation. The force distribution effect is the obvious result of the compressibility of the gripping force controlling and distributing compressible material element. Such force distribution is important when a bag is mounted in the present invention because it prevents application of large stress producing forces at points on a bag and the bag tearing which can occur as a result, as previously alluded to. The force controlling aspect of the gripping force controlling and distributing compressible material elements is also the result of the compressibility of the compressible material used in the gripping force controlling and distributing compressible material elements and the increased gripping action thereof which occurs as additional material with weight associated therewith is placed into a gripped bag. When a bag is restrained within the system of the preferred embodiment of the invention which includes gripping force controlling and distributing compressible material elements, the restraining levers can be configured to be rotated to their fully closed position with the lower aspect of their horizontally projecting extents resting on the top of their associated pivot brackets. As more material with a weight associated therewith is placed into a restrained bag, the compressible material is caused, by the action of the restrained bag attempting to pull free of the gripping force, and by friction between the restrained bag and the compressible material in the gripping force controlling and distributing compressible material elements, to change shape so as to better contact the outer vertical surfaces of the associated side arms and, thus, better grip a restrained bag. Note that this occurs without the requirement that wear associated rotation of the restraining lever take place. Said action serves to save wear of the restraining lever pivot mechanism as well as provide automatically variable restraining forces as same are required to restrain bags as the weight therein changes.

In a variation of the preferred embodiment just described, the restraining levers are mounted to the pivot brackets in a manner which allows a slight rotation to occur, in response to an attempt to pull a bag free, just prior to the gripping action of the compressible material becoming fully responsible for control of the restraining force applied to the bag within the system. When the open top edge of a bag is placed into said variation of the preferred embodiment, the restraining levers assume a "ready" position. As material with weight associated therewith is added to the bag, the restraining levers rotate slightly to the position in which the lower aspect of their horizontal extents rests on the tops of the the associated pivot brackets. This immediately increases the gripping force applied to the open edges of a restrained bag immediately in response to an applied force which attempts to free the bag. Following the slight rotation from the ready position, the shape change automatic restraining force controlling and distributing action of the compressible material elements again becomes completely responsible for controlling the gripping force applied to the open edge of a restrained bag, in a manner which does not require further restraining lever rotation.

It will also be noted that the system can be operated to release a bag in a quick, tear preventing, one step action by a user who simultaneously operates both restraining levers to rotate the left restraining lever clockwise and the right restraining lever counterclockwise simultaneously, (as the invention is viewed from the front in elevation).

Also to be noted is that as a bag mounted in the system of the present invention assumes a position in which the bag is pulled up past the inner vertical side arm surfaces and then over the tops of the side arms, the forces which hold the bag up while it is restrained within the system are distributed along the tops of the side arms as well as being evenly distributed along the lengths of the restraining levers which contact the outer vertical side arm surfaces. Again, this force distributing mechanism reduces the chances that a restrained bag will be torn.

It is also noted that the restraining levers of the present invention can be, in a non-preferred embodiment configuration of the present invention, attached to the base mounting rail so that the restraining levers are oriented to face the inner vertical surfaces of the side arms. This is accomplished by simply placing the side arm which heretofore was described as mounting at the right side of the base mounting rail, on the left thereof, and the side arm which was heretofore described as normally mounting to the left side of the base mounting rail on the right thereof. The invention, in said configuration, requires that a bag gripped therein mount with its top open edge pulled over the top of the horizontal extents of the restraining levers and into the space between the restraining levers and their associated inner vertical side arm surfaces. In such a configuration the restraining force controlling and distributing compressible material elements are normally not used to fully control the gripping force, but rather the restraining levers are set so that the lower aspect of their horizontal extents do not set upon the tops of their associated pivot brackets. As a result, as more material with weight associated therewith is placed into a restrained bag, the natural action of the system causes the lever arms to further rotate into a position which better restrains the bag.

The invention can also be used to restrain items other than bags. For instance, strings or rope might be stretched between the side arms and restrained by the restraining levers. Tree branches and twigs etc. can then be placed thereon and easily secured into a bundle. Alternatively, a piece of pliable material such as canvas can be drapped between the side arms and restrained by the restraining levers to form a "saddle" arrangement.

In addition, the present invention can also include a storage bin which attaches to the back of the base mounting rail, via connection means, such as keys and key slots, as were described with respect to the attachment means for the side arms to the front of the base mounting rail.

The invention will be described more precisely, in conjunction with drawings, in the Detailed Description Section.

SUMMARY OF THE INVENTION

A search of prior Patents has shown that inventions which restrain bags in an open position, some of which are meant to be mounted to two wheel transport units, are known in the art. Careful consideration of the prior inventions leads one to realize, however, that the prior inventions are not optimum. While prior Patents individually teach various inventions which have elements therein which provide utility, no Patent of which the Inventor is aware at once teaches an invention which provides for easy installation to any stable support, which stable support can be the tubular uprights of a two wheel transport unit; which provides for easy adjustment of the vertical positioning of the invention on a two wheel transport unit and for the easy adjustment of the distance between protruding bag restraining elements so that the invention can effectively handle bags of various diameters as well as various lengths; which provides for quick removal of protruding bag restraining elements from a two wheel transport unit so that the two wheel transport unit can be easily and quickly converted back to a material transport unit; which provides means by which bags can be automatically restrained within the self contained bag restraining elements of the invention in a gripping force controlled and distributing manner which prevents bags from being subjected to large stresses which result from point applied forces and thereby becoming torn; and which provides means by which restrained bags can be released in a quick one step action by a user of the invention.

In view of the foregoing, it is a purpose of the present invention to provide a system and method of its use which, at once, provides the identified attributes.

DETAILED DESCRIPTION

Figure 1:
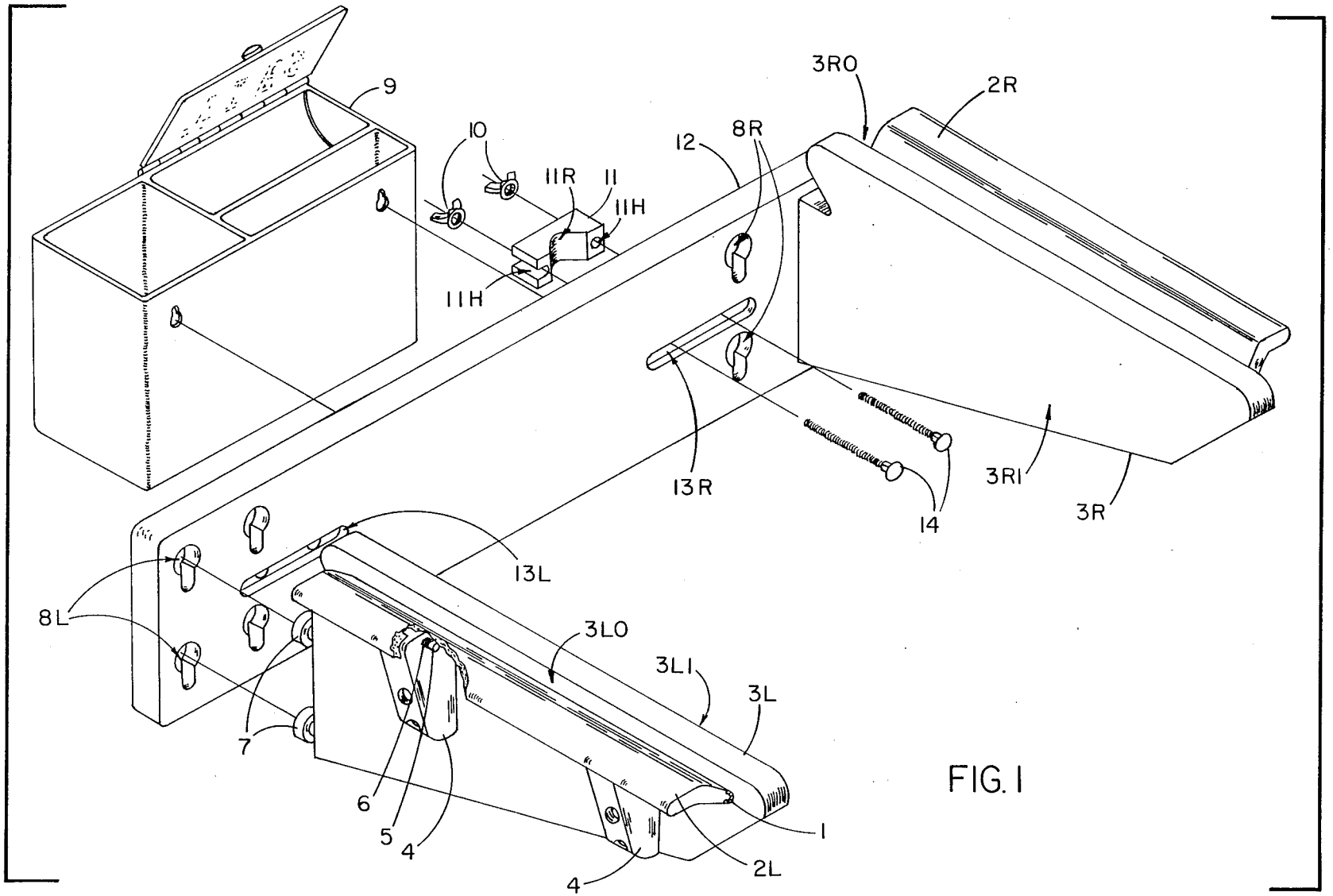
FIG. 1 shows an exploded elemental assembly view of the invention as seen in perspective from a distance looking downward at the front left corner of the invention.
Figure 3:
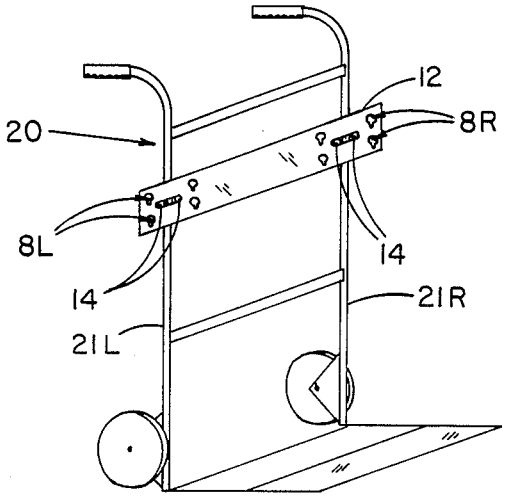
FIG. 3 shows a perspective view, as seen looking downward at the front left corner of a two wheel transport unit to which is attached a base mounting rail.

Referring now to the drawings, in FIG. 1 there is shown an exploded elemental assembly view of the invention in seen in perspective from a distance looking downward at the front left corner. In particular there is shown a base mounting rail (12). FIG. 3 shows said base mounting rail (12) affixed to a vertically oriented two wheel transport unit (20). In use the base mounting rail (12) is secured to the left and right tubular uprights (21L) and (21R) of the two wheel transport unit (20) by means of bolts (14), (see FIG. 1), which bolts extend through right and left elongated slots (13R) and (13L) in the base mounting rail (12). Said bolts (14) pass through holes (11H) in clamping blocks (11), which holes (11H) can be open sided and which holes are positioned on both sides of the two tubular uprights (21L) and (21R) of a two wheel transport unit fitted with the present invention. The bolts (14) are secured by way of wing nuts (10) or equivalent securing elements at the back of said clamping block. Note that FIG. 1 shows bolts (14) and a clamping block (11) only on the right side of the base mounting rail and in conjunction with the right side elongated slot (13R). It is to be understood that a similar arrangement is also present on the left side of the base mounting rail (12) to allow securing the base mounting rail to the left tubular upright as well, but same is not shown to avoid clutter in the drawing. It is to be observed that the clamping blocks (11) have a recess (11R) therein on their forward side as viewed in FIG. 1, which recess (11R) is of a size and shape proper to engage the tubular uprights (21L) and (21R) of a two wheel transport unit and cause said tubular uprights (21L) and (21R) to be effectively clamped between said clamping blocks (11) and the back side of the base mounting rail (12) when the bolts (14) are extended through the elongated slots (13L) and (13R) in the base mounting rail (12) and then through the holes in the clamping blocks (11H), which holes are on both sides of each of the two tubular uprights. The base mounting rail then is seen to be easily mounted to a two wheel transport unit in a manner which allows easy adjustment of the vertical position on the two wheel transport unit, one such vertical position being demonstrated in FIG. 3. It is also disclosed that the preferred embodiment of the clamping blocks (11) provides a recess (11R) with tapering sides so that a tubular upright of a two wheel transport unit is clamped via a three point contact, two points being within a clamping block (11) and the third being at the back side of the base mounting rail (12). Such a recess shape is not required by the invention, but it does facilitate use of single design for clamping blocks (11) used with various two wheel transport units which various two wheel transport units have tubular uprights (21R) and (21L) of various diameters.

Proceeding, FIG. 1 also shows that base mounting rail (12) has connection means, demonstratively shown as key slots (8L) and (8R) therein. Two pairs of such key slots (8L) are shown on the left side of the base mounting rail and one complimentary pair (8R) is visible at the right side thereof. It is to be understood that additional sets of such complimentary connection means can also be present. Connection means, demonstrated as key slots (8L) and (8R), are present in the base mounting rail (12) to allow easy mounting of side arms (3L) and (3R) to said base mounting rail (12), via connection means, demonstrated as keys (7), which keys (7) are shown mounted to the breadth dimensional area at the back of the left side arm (3L) in FIG. 1, and are likewise present in a similar position on right side arm (3R), (not shown). It will be appreciated that the distance between right and left side arms (3L) and (3R) can be easily changed by mounting the side arms (3L) and (3R) into different complimentary pairs of key slots (8L) and (8R).

Figure 2:
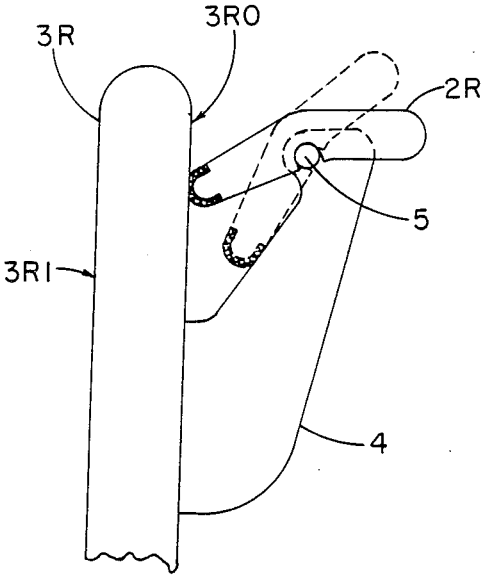
FIG. 2 shows a front elevational view of the invention's right side arm, pivot pin, pivot bracket, and right restraining lever in a closed, (solid lines), restraining space position. Also shown is a phantom view of the restraining lever in an open restraining space position, (broken lines), in which position a restrained bag will be released.

Focusing now on the side arms (3L) and (3R), and attachments thereto, it will first be recognized that the right and left side arms (3L) and (3R) form mirror images of one another. FIG. 1 shows that similar pivot brackets (4) attach to the side arms (3L) and (3R) on their outer vertical surfaces (3LO) and (3RO) in the preferred embodiment, but that they are facing in opposite directions. The configuration for the right side arm (3R) is shown very well in FIG. 2. A similar drawing for the left side arm (3L), (not shown), would be a simple mirror image of the drawing in FIG. 2. Restraining levers (2L) and (2R) are secured to the pivot brackets (4) via pivot pins (5). It will also be noted that the restraining levers (2L) and (2R), in a preferred embodiment, have gripping force controlling and distributing compressible material elements (1) mounted along the lengths of the restraining levers (2L) and (2R) where restraining levers (2L) and (2R) contact the outer vertical surfaces of the side arms (3L) and (3R), respectively, when the system is in the closed restraining space position, (see FIG. 2 which shows the closed restraining space position in solid lines and an open restraining space position in broken lines). In the preferred embodiment, said gripping force controlling and distributing compressible material elements (1) serve to not only distribute restraining forces, but to also automatically control the gripping force applied to restrain a bag in the invention in response to the presence of increased material in said restrained bag, which material has weight associated therewith. With the gripping force controlling and distributing compressible material elements (1) in place, the invention can be configured so that when a bag is restrained, the lower aspects of the horizontally projecting extents of restraining levers (2L) and (2R) are resting on the tops of the associated pivot brackets. As weight is added to a restrained bag, the shape of the compressible material is caused to change as a result of interaction between the compressible material and the bag, as the bag attempts to pull free of the point at which it is restrained. Said shape change of the compressible material causes automatic required changes in the restraining forces developed. In a slightly different configuration the restraining levers (2L) and (2R) can be mounted to the pivot brackets (4) so that a slight rotation can occur just prior to the action of the gripping force controlling and distributing elements (1) taking complete control, as just described. In this configuration an immediate response to an applied force which attempts to pull a bag from the system occurs as a result of the rotation of the restraining levers (2L) and (2R).

Springs (6), (see FIG. 1), are indicated as being present to provide a source of torsion producing forces which serve to keep the gripping force controling and distributing compressible material elements (1) in contact with the outer vertical surfaces of the side arms (3LO) and (3RO) when the restraining levers (2L) and (2R) are in a closed restraining space position. Springs (6) mount between the pivot brackets (4) and their associated restraining levers (2L) and (2R). While it is possible to achieve the same result by properly weighting the restraining levers, it has been found that the springs (6) serve to provide a more reliable orientation of the restraining levers (2L) and (2R). This is of importance as when one mounts a bag into the system of the present invention, the typical action is to simply grasp a length of the top open edge of the bag in excess of the length of the restraining levers (2L) and (2R), between one's hands, and slide same in between the vertical outer surfaces of each side arm and its associated restraining lever. It is important that the restraining levers be positioned properly to receive said top open edge of a bag without user action to rotate them into a proper position. The presence of the springs (6) assures proper positioning of said restraining levers (2L) and (2R).

To finish introducing the elements of the present invention, as an additional element, a storage bin (9) can be included. Said storage bin (9) attaches, in the preferred embodiment, to the back of the base mounting rail (12), by way of connection means which are again demonstrated as keys and key slots, similar to those described in conjunction with the mounting of the side arms (3L) and (3R) to the front of the base mounting rail (12).

It will be appreciated that the elements described herein are demonstrative and are shown to explain the present invention, rather than to exclude functionally equivalent elements. For example the wing nuts (10) can be replaced with other securing elements, and the clamping blocks (11) can have a recess designed other than as specifically described. The Claims are to be interpreted to include such functional equivalents.

Figure 4:
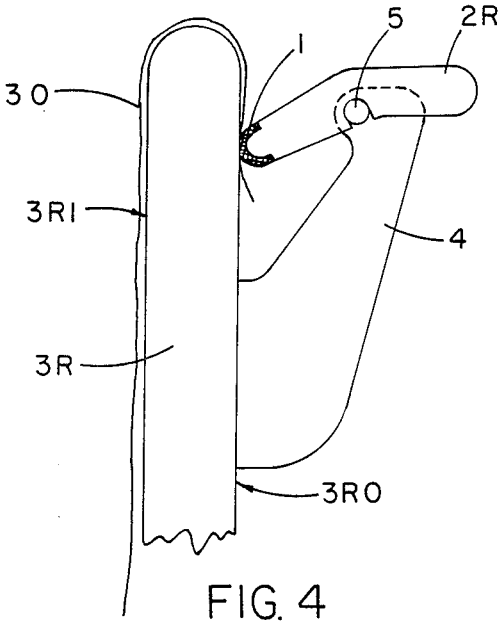
FIG. 4 shows a front elevational view of the invention's right side arm, pivot pin, pivot bracket, and right restraining lever with a bag inserted and restrained between the right restraining lever and the outer vertical surface of the right side arm.
Figure 5:
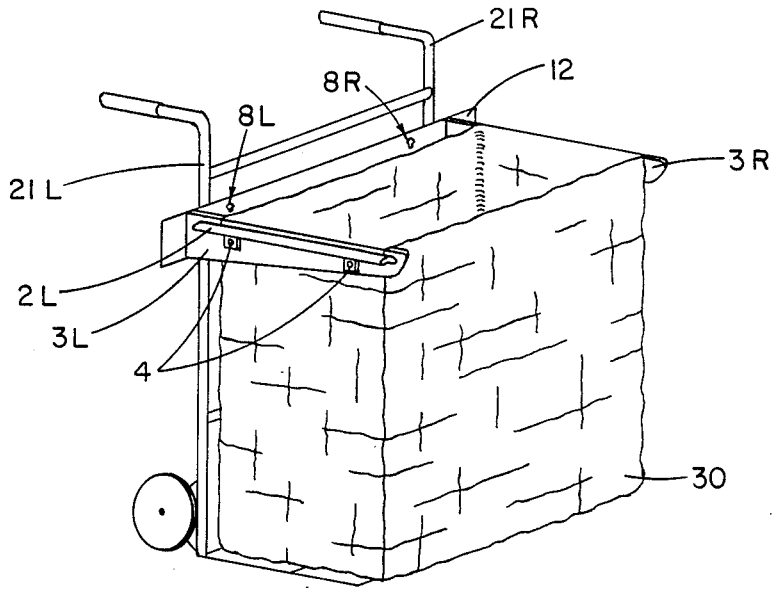
FIG. 5 shows a perspective view, as seen looking downward at the front left corner, of a two wheel transport unit to which is attached a preferred embodiment of the present invention, with a bag restrained therein.

With the elements of the present invention identified, attention is now directed to the operation of the combined system. Referring to FIG. 4, one can appreciate that a partial front elevational view of the right side arm (3R) and attached pivot bracket (4) and restraining lever (2R) is shown. A similar, but mirror image configuration, (not shown), requiring opposite operational rotations to those described directly, will exist for the left side arm (3L) and left restraining lever (2L), and this should be kept in mind when reading the following description of the operation of the system elements on the right side of the invention. Additionally, a top open edge of a bag (30) is shown in a position which would result from having been pulled upward past the inner vertical surface of the right side arm (3RI), over the force distributing top aspect thereof and down between the right outer vertical side arm surface (3RO) and the gripping force controlling and distributing compressible material element (1) along the length of the restraining lever (2R) which contacts the outer vertical surface of the side arm (3RO) when the restraining lever (2R) is in a closed restraining space position. To so position the top edge of a bag (30), the right restraining lever (2R) must be slightly rotated counterclockwise to provide an open restraining space between the restraining lever (2R), and the respective outer vertical surface of the associated side arm (3RO). One can also appreciate that a similar, but opposite, slight clockwise rotation must be applied to the left restraining lever to open a restraining space at the left side of the system.

To position a bag as described above, one must simply grip the top open edge thereof, with a length greater than that of a restraining lever, between his or her hands, and simply slide the top open edge of the bag between the outer vertical surfaces of the side arms and their respective restraining levers. Immediately after said action the restraining levers (2L) and (2R) will, as a result of forces created by springs (6) rotate into a "ready" position. Once a bag is positioned as described on both the right and left sides of the system the restraining levers (2L) and (2R) are oriented to enable provision of effective bag restraining forces between the lengths of the restraining levers (2L) and (2R) which contact the outer vertical surfaces of the side arms (3LO) and (3RO) when the system is in a closed restraining space position, and the vertical outer side arm surfaces. It will be appreciated that any attempt to then pull the bag from between the outer vertical surfaces of the side arms (3RO) and (3LO) and the gripping force controlling and distributing compressible material elements (1), which are along the lengths of the restraining levers (2R) and (2L) which contact the outer vertical surfaces of the side arms in a closed restraining space position, in the prefered embodiment, will simply lead to better gripping and a firmer restraint of the bag to occur. This is the result even if the lower aspects of the horizontally projecting extents of the restraining levers (2R) and (2L) are resting on the tops of their associated pivot brackets and said restraining levers are unable to rotate clockwise and counterclockwise respectively, if the gripping force controlling and distributing compressible material elements are present on the restraining levers (2L) and (2R) in the positions already described. The compressible material is caused to change shape and automatically effect increased bag restraining force as material with weight associated therewith is placed into the restrained bag. This occurs as a result of friction and interaction between the compressible material and the restrained bag as the restrained bag attempts to pull free of the point at which it is restrained. If, as is normally the case, the restraining levers (2L) and (2R) are mounted to the pivot brackets (4) so that the lower aspects of the horizontal extents of the restraining levers do not quite rest upon the tops of their respective pivot brackets when the open top edge of a bag is placed into the sytem, a slightly different action occurs. So configured the restraining levers (2L) and (2R) are in what is termed the "ready" position. As a force is then applied to the gripped bag which tends to pull the gripped bag free of the system, the restraining levers (2L) and (2R) first rotate slightly to immediately respond to the requirement for increased gripping force. Following said slight rotation, the lower aspect of the horizontal extents of the restraining levers (2L) and (2R) contact the tops of their respective pivot brackets (4) and the compressible element shape change automatic gripping force controlling and distribution effect takes over and the system responds as described above.

If, as in a non preferred embodiment, the gripping force controlling and distributing compressible material elements are not present, then rotational action of the restraining levers can, and must, be relied upon to produce bag restraining forces. This requires that the lower aspect of the horizontally projecting extents of the restraining levers do not contact the tops of the pivot brackets to which they are pivotally attached. This is the case as the right and left restraining levers (2R) and (21) are of such size and shape that they can rotate only through a partial arc. Said restraining levers (2R) and (2L), respectively, can not rotate clockwise and counterclockwise around the pivot pins (6) which attach them to their associated pivot brackets (4), beyond the point at which the length of the restraining levers which contact the outer vertical surfaces of their associated side arms when the system is in the closed restraining space position, contact said outer vertical surfaces of the side arms (3RO) and (3LO). Pulling on a restrained bag causes an opposite, and bag restraining, reaction to occur because of the frictional interaction between the restrained bag and the blocked rotation of the restraining levers (2R) and (2L) in the presently described non-preferred embodiment of the present invention. This is so as the bag (30) is, again, restrained between the outer vertical surfaces of the side arms (3RO) and (3LO) and the respective restraining levers (2R) and (2L).

The presence of the the gripping force controlling and distributing compressible material elements (1), in the prefered embodiment, serves to enhance the operation of the invention by better distributing forces and by developing better frictional contact between a restrained bag and the restraining elements of the invention between which the bag is restrained. Also, it is again noted, that when the gripping force controlling and distributing compressible materials elements are present on the restraining levers, the restraining levers do not have to rotate, except for a slight amount in a variation of the preferred embodiment as described above, to effect improved bag restraint in response to material with weight associated therewith being placed into the restrained bag. Again, this is because the compressible material automatically controls the restraining force by changing shape. This prevents wear of the pivot mechanisms by which the restraining levers connect to their respective pivot brackets, while also limiting the amount of force exerted on the pivot brackets by the restraining levers.

To release a bag from the invention it is necessary to rotate the left restraining lever (2L) clockwise and the right restraining lever (2R) counterclockwise, thereby reopening a space between the outer vertical surfaces of the respective side arms (3LO) and (3RO) and the lengths of the restraining levers (2L) and (2R) which contact the outer vertical surfaces of the side arms (3LO) and (3RO) when the restraining levers (2L) and (2R) are in a closed restraining space position.

It will be appreciated that the invention can be easily adjusted to accommodate use with bags of various sizes. The vertical location of the base mounting rail (12) on a two wheel transport unit can be adjusted to accomodate bags of various lengths by loosening the wing nuts (10) or equivalent securing elements, moving the base mounting rail, clamping blocks (11) and bolts (14), vertically up or down, and resecuring the system of elements to the tubular uprights (21R) and (21L) by way of tightening the wing nuts (10) or equivalent securing elements. The invention can be adjusted to accomodate bags of various diameters by attaching the side arms (3L) and (3R) to the base mounting rail (12) via various complimentary key slot pairs, (8L) and (8R), or equivalent connection means, in said base mounting rail (12).

It will be appreciated that bags restrained by the present invention will not be subjected to large stresses resulting from point applied restraining forces which tend to cause bags to tear. Restraint force distribution will occur along the top of the side arms (3R) and (3L), over which the bag's top open edge is positioned, and restraint forces are otherwise distributed long the entire locus on the outer vertical side arm (3LO) and (3RO) surfaces where they are contacted by the lengths of the restraining levers (2L) and (2R) which contact said outer vertical side arm surfaces (3LO) and (3RO) when the restraining levers (2L) and (2R) are in the closed restraining space position.

It is also of interest to note that the invention can be quickly operated to prevent bags from being torn when they are released. A user of the invention can, in one quick step, simultaneously rotate both restraining levers (2L) and (2R) to their open restraining space release positions without any single point on the restrained bag (30) being released after other points on the bag. Thus, no large bag tearing single point application forces develop during bag release.

Figure 6:
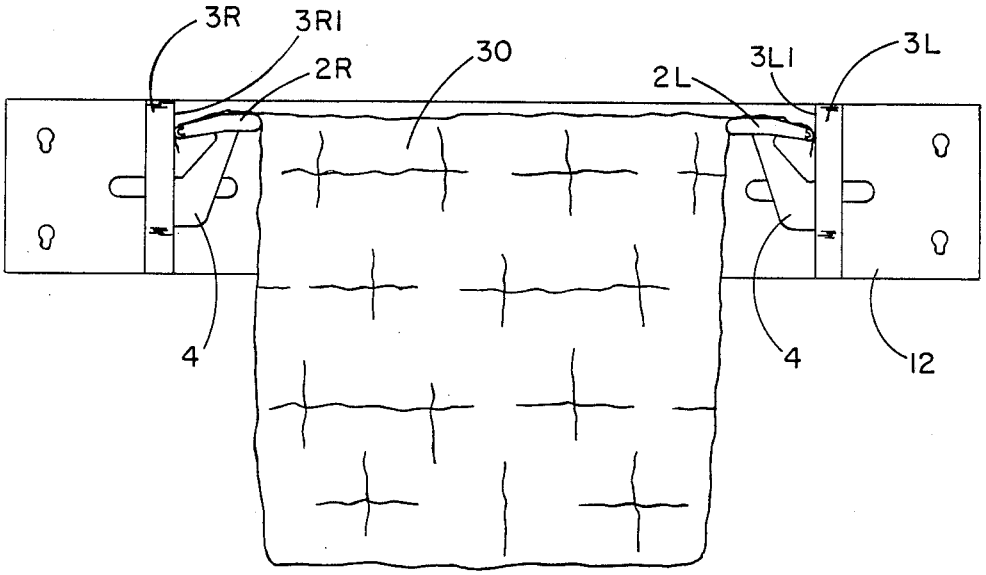
FIG. 6 shows a front elevational view of a non-preferred embodiment configuration of the present invention, with a bag restrained therein.

In another, non-preferred embodiment of the invention, shown in FIG. 6 in frontal elevation, it is the practice to mount the side arms to the base mounting rail so that the side arm heretofore described as being attached to the left side (3L) of the base mounting rail (12) is instead connected to the right side thereof. Similarly the side arm (3R) heretofore described as being attached to the right side of the base mounting rail (12) is mounted to the left side thereof. In said configuration a bag mounted in the system will be pulled up and over the horizontally projecting extents of the restraining levers, rather than over the top aspects of the side arms, prior to being slid into the space between what become the inner side arm surfaces (3LI') and (3RI') and the lengths of the restraining levers which contact said inner side arm surfaces when the system in in a closed restraining space position. In this alternate configuration the lower aspects of the horizontally projecting extents of the restraining levers can be oriented so as to normally not contact the tops of the associated pivot brackets to which they are pivotally attached. As material with weight associated therewith is placed into a bag restrained in said reconfigured system the natural effect is that the restraining levers are caused to rotate and better restrain the bag, by the presence of said weight. Of course, the restraining levers (2L) and (2R) can be mounted so that the lower aspects of their horizontally projecting extents can contact the tops of their associated pivot brackets (4) when a bag is placed into the system, or so as to assume a "ready" position as described in regards to the preferred embodiment. As well, the gripping force controlling and distributing elements (1) can be mounted to the restraining levers (2L) and (2R) in this non-preferred embodiment of the invention and the automatic bag restraining force control action associated therewith, as described above in conjunction with the preferred embodiment of the invention, used to provide an advantage similar to that described in conjunction with the preferred embodiment.

While not shown, means for adjusting the position of the lower aspect of the horizontal aspects of the restraining levers (2L) and (2R) with respect to the tops of their associated pivot brackets when the restraining levers are in the "ready" position can be present.

Also note that, in any embodiment, the connection means, demonstrated by keys (7) and key slots (8), by which the side arms (3L) and (3R) attach to the base mounting rail (12) provides for easy and quick removal of side arms (3L) and (3R) in the event that the two wheel transport unit is required for use as a material transport unit rather than a bag restraining unit.

It should also be recognized that the present invention can be used to restrain other than bags. For instance a piece of pliable material, (e.g. canvas), can be stretched or draped between the two side arms (3L) and (3R) and be caused to become restrained as described with respect to bags in the preferred embodiment, between the outer vertical surfaces of the side arms (3LO) and (3RO) and the length of the restraining levers (2L) and (2R) which contact the outer vertical surfaces of the side arms (3LO) and (3RO) when the restraining levers (2L) and (2R) are in a closed restraining space position. A "saddle" configuration would be the result. As well, strings or ropes can be similarly restrained, and then branches or twigs etc. placed thereon, where they can be conveniently tied into bundles.

Having hereby disclosed the subject matter of this invention, it should be obvious that many modifications, substitutions, and variations of the present invention are possible in light of the teachings. It is therefore to be understood that the invention may be practised other than as specifically described, and should be limited in breadth and scope only by the Claims.

We claim:

1. A bag restraining system, which bag restraining system comprises a base mounting rail, which base mounting rail, when viewed from the front with the longitudinal dimension oriented horizontally and the width dimension oriented vertically in elevation, presents with right and left side elongated slots therein, positioned longitudinally to the right and left of the longitudinal center line which is perpendicular to the longitudinal dimension of the base mounting rail at the mid point thereof, and which elongated slots are in line with, or parallel to, the vertical center line which extends the longitudinal to, the vertical center line which extends the longitudinal length of the base mounting rail at the vertical mid point thereof; which base mounting rail further has a multiplicity of right and left side complimentary pairs of detachable connection means, which bag restraining system further comprises right and left side arms, which right and left side arms attach to, in an easily removable manner, and project perpendicularily from the base mounting rail, by way of said detachable connection means, which mesh with complimentary connection means present on the back of each of the right and left side arms within the breadth dimensional area thereof, and to which right and left side arms, on the outer vertical surfaces thereof are attached pivot brackets, to which pivot brackets are attached restraining levers by way of pivot pins such that the restraining levers are free to rotate about their pivot pin connection points in a partial arc limited to what is termed the closed restraining space position which, for the right restraining lever, is in the clockwise direction and where the length of the right restraining lever nearest the outer vertical surface of the right side arm contacts the outer vertical surface of the right side arm and the lower aspect of the outer horizontal extent of the right restraining lever is in contact with or in close proximity to the top of the right pivot bracket to prevent over-rotation of said right restraining lever, and for the left restraining lever, is in the counter-clockwise direction and where the length of the left restraining lever nearest the outer vertical surface of the left side arm contacts the outer vertical surface of the left side arm and the lower aspect of the outer horizontal extent of the left restraining lever is in contact with or in close proximity to the top of the left pivot bracket to prevent over-rotation of said right restraining lever: in which closed restraining space position the top open edge of a bag, or other materials, can be restrained, which restraining levers are each, in length, a significant portion of the length of the side arms to which they are attached so that bag restraining force distribution along said length can be achieved in use, thereby avoiding point application thereof to a bag, or other material, restrained in the bag restraining system.

2. A bag restraining system as in claim 1 which bag restraining system further comprises clamping blocks, which claming blocks have at least two holes therethrough and a recessed area on one side thereof, from which same side as there exists the recessed area said holes are also accessible, one such hole being on each side of the recessed area, which recessed area is of a proper size and shape to surround and contact tubular uprights on a two wheel transport unit, the purpose of said clamping blocks being to provide a means by which the base mounting rail can be attached to the tubular uprights of a two wheel transportation unit via the use of bolts, which bolts extend through the right and left extended slots on the base mounting rail past both sides of the tubular uprights of a two wheel transport unit, through the holes in the clamping block, where said bolts are secured by securing elements such as wing nuts, the result being that the tubular uprights of the two wheel transport unit become clamped between the clamping blocks and the back of the base mounting rail.

3. A bag restraining system as in claim 2 in which the recessed area of the clamping blocks is shaped so as to provide two points of contact to a tubular upright of a two wheel transport unit when said tubular upright is clamped between the clamping block and the back side of the base mounting rail, a third point of contact to the tubular upright being provided by said back of the base mounting rail.

4. A bag restraining system as in claim 1 in which the lengths of the right and left restraining levers which contact the outer vertical surfaces of the right and left side arms respectively when the system restraining levers are in a closed restraining space position have attached thereto gripping force controlling and distributing compressible material elements which gripping force controlling and distributing compressible material elements serve to automatically respond to the need for increased or decreased restrained bag gripping forces and to distribute bag restraining gripping forces, with or without the requirement that the restraining levers pivot about their connection points to their associated pivot brackets, thereby, in the later case, providing for less wear on said pivot connection elements, and in both cases for better bag restraint gripping force control and serving to lessen the possibility that a bag restrained by the system will become torn by the system, when restrained therein, or when released therefrom.

5. A bag restraining system as in claim 1 in which springs are present at the locations of the right and left pivot pins, which springs attach to the pivot brackets and their associated restraining levers and which springs serve to develop torsion producing forces between the right and left pivot brackets and their associated restraining levers arms respectively, which forces serve to develop contacts between the outer vertical surfaces of the right and left side arms and the associated right and left restraining levers, along the length of said right and left restraining levers which contact the outer vertical surfaces of the right and left side arms when the restraining levers are in a "ready" position.

6. An automatic gripping force controlling and distributing system which attaches to a bag restraining system as in claim 1, which automatic gripping force controlling and distributing system comprises a compressible material secured to the lengths of the restraining levers which contact the outer vertical surfaces of the side arms when the bag restraining system is in the closed restraining space position, which automatic gripping force controlling and distributing system serves to, either alone or in conjunction with restraining lever rotation, automatically control and distribute the restraining forces which grip a bag, or other material, placed between the compressible material on one side and the vertical surface of a side arm on the other side, by reacting to applied forces which tend to pull a restrained bag from the system, by changing shape.

7. A bag restraining system as in claim 1 in which the side arm which normally attaches to the right side of the base mounting rail is attached to the left side thereof, and in which the side arm which normally attaches to the left side of the base mounting rail is attached to the right side thereof such that the restraining levers are located in positions on the inner vertical surfaces of the respective side arms.

8. A method of restraining bags comprising the steps of:

a. obtaining a bag restraining system, which bag restraining system comprises a base mounting rail, which base mounting rail, when viewed from the front with the longitudinal dimension oriented horizontally and the width dimension oriented vertically in elevation, presents with right and left side elongated slots therein, positioned longitudinally to the right and left of the longitudinal center line which is perpendicular to the longitudinal dimension of the base mounting rail at the mid point thereof, and which elongated slots are in line with, or parallel to, the vertical center line which extends the longitudinal length of the base mounting rail at the vertical mid point thereof; which base mounting rail further has a multiplicity of right and left side complimentary pairs of detachable connection means, which bag restraining system further comprises right and left side arms, which right and left side arms attach to, in an easily removable manner, and project perpendicularily from the base mounting rail, said detachable connection means, slots, which mesh with complimentary connection means present on the back of each of the right and left side arms within the breadth dimensional area thereof, and to which right and left side arms, on the outer vertical surfaces thereof are attached pivot brackets, to which pivot brackets are attached restraining levers by way of pivot pins such that the restraining levers are free to rotate about their pivot pin connection points in a partial arc limited to what is termed the closed restraining space position which, for the right restraining lever, is in the clockwise direction and where the length of the right restraining lever nearest the outer vertical surface of the right side arm contacts the outer vertical surface of the right side arm and the lower aspect of the outer horizontal extent of the right restraining lever is in contact with or in close proximity to the top of the right pivot bracket to prevent over-rotation of said right restraining lever, and for the left restraining lever, is in the counter-clockwise direction and where the length of the left restraining lever nearest the outer vertical surface of the left side arm contacts the outer vertical surface of the left side arm and the lower aspect of the out horizontal extent of the left restraining lever is in contact with or in close proximity to the top of the left pivot bracket to prevent over-rotation of said right restraining lever; in which closed restraining space position the top open edge of a bag, or other materials, can be restrained, which restraining levers are each, in length, a significant portion of the length of the side arms to which they are attached so that bag restraining force distribution along said length can be achieved in use, thereby avoiding point application thereof to a bag, or other material, restrained in the bag restraining system;

b. securing said bag restraining system to a two wheel transport system;

c. grasping the top open edge of a bag in one's hands, the length of which is in excess of the length of a restraining lever and sliding said length of the top open end of the bag in between the outer vertical surface of the right side arm and the length of the right restraining lever which contacts the outer vertical surface of the right side arm when in the closed restraining space position; and d. repeating step c for the left side of the system.

9. A method of adjusting a bag restraining system for use with various diameter bags, which comprises the steps of:

a. obtaining a bag restraining system, which bag restraining system comprises a base mounting rail, which base mounting rail, when viewed from the front with the longitudinal dimension oriented horizontally and the width dimension oriented vertically in elevation, presents with right and left side elongated slots therein, positioned longitudinally to the right and left of the longitudinal center line which is perpendicular to the longitudinal dimension of the base mounting rail at the mid point thereof, and which elongated slots are in line with, or parallel to, the vertical center line which extends the longitudinal length of the base mounting rail at the vertical mid point thereof; which base mounting rail further has a multiplicity of right and left side complimentary pairs of detachable connection means, which bag restraining system further comprises right and left side arms, which right and left side arms attach to, in an easily removable manner, and project perpendicularily from the base mounting rail, by way of said detachable connection means which mesh with complimentary connection means connection means, preferably keys, present on the back of each of the right and left side arms within the breadth dimensional area thereof, and to which right and left side arms, on the outer vertical surfaces thereof are attached pivot brackets, to which pivot brackets are attached restraining levers by way of pivot pins such that the restraining levers are free to rotate about their pivot pin connection points in a partial arc limited to what is termed the closed restraining space position which, for the right restraining lever, is in the clockwise direction and where the length of the right restraining lever nearest the outer vertical surface of the right side arm contacts the outer vertical surface of the right side arm and the lower aspect of the outer horizontal extent of the right restraining lever is in contact with or in close proximity to the top of the right pivot bracket to prevent over-rotation of said right restraining lever, and for the left restraining lever, is in the counterclockwise direction and where the length of the left restraining lever nearest the outer vertical surface of the left side arm contacts the outer vertical surface of the left side arm and the lower aspect of the outer horizontal extent of the left restraining lever is in contact with or in close proximity to the top of the left pivot bracket to prevent over-rotation of said right restraining lever; in which closed restraining space position the top open edge of a bag, or other materials, can be restrained, which restraining levers are each, in length, a significant portion of the length of the side arms to which they are attached so that bag restraining force distribution along said length can be achieved in use, thereby avoiding point application thereof to a bag, or other material, restrained in the bag restraining system;

b. selecting the detachable connection means on the base mounting rail which provide the desired distance between the right and left side arms for use with the bag of a given diameter; and c. mounting the right and left side arms into said detachable connection means on the right and left sides of the base mounting rail.

* * * * *